United States Patent [19]

Gabbay et al.

[11] Patent Number: 4,608,707

[45] Date of Patent: Aug. 26, 1986

[54] ROTATING ANODE X-RAY TUBE PROVIDED WITH A CHARGE FLOW DEVICE

[75] Inventors: Emile Gabbay, Paris; André Plessis, Clamart, both of France

[73] Assignee: Thomson-CGR, Paris, France

[21] Appl. No.: 623,714

[22] Filed: Jun. 22, 1984

[30] Foreign Application Priority Data

Jul. 6, 1983 [FR] France ..... 83 11260

[51] Int. Cl.[4] ..... H01J 35/04

[52] U.S. Cl. ..... 378/132; 378/122; 378/125

[58] Field of Search ..... 378/125, 132, 144, 119, 378/121, 134, 122, 124, 134, 131

[56] References Cited

U.S. PATENT DOCUMENTS 4,081,707 3/1978 Hartl et al. ..... 378/132

4,167,671 9/1979 Boden et al. ..... 378/132

4,414,681 11/1983 Seifert ..... 378/144

4,417,171 11/1983 Schmitmann ..... 378/131

*Primary Examiner*—Carolyn E. Fields

*Attorney, Agent, or Firm*—Roland Plottel

[57] ABSTRACT

The invention relates to a rotating anode X-ray tube provided with a charge flow device, in which the anode current of the tube is established between an emitter coupled in rotation to the rotating anode, as well as a fixed collector. The latter is electrically connected to high voltage and the emitter is electrically connected to the rotating anode, having at least one part with a tapered end constituting an electron emissive zone. These electrons are trapped by the collector, so as to establish the anode current of the tube without any material contact between the emitter and the collector. The invention is applicable to radiology in general and more specifically to medical diagnosis.

10 Claims, 3 Drawing Figures

ROTATING ANODE X-RAY TUBE PROVIDED WITH A CHARGE FLOW DEVICE

BACKGROUND OF THE INVENTION

The invention relates to a rotating anode X-ray tube provided with a charge flow device, in which the anode current constituted by these charges flows without material contact between the fixed parts and the rotating parts of the tube, the latter being of the type having magnetic bearings. Such an X-ray tube can be used in all fields of radiology and particularly that of medical diagnosis.

Medical diagnosis X-ray tubes are generally constructed in the same way as a diode, i.e. comprising two electrodes, one of which called the cathode emits electrons, whilst the other electrode called the anode or anticathode receives these electrons over a small surface constituting the focus. These electrodes are enclosed in a vacuum-tight envelope and permit the electrical insulation between the two electrodes.

The cathode has a concentration part in which is located a heated filament constituting the electron source. When high voltage is applied to the terminals of the two electrodes in such a way that the cathode is at negative potential, a so-called anode current is established in the circuit across the high voltage generator. This current passes through the space between the cathode and the anode in the form of an electron beam, whose intensity is dependent on the temperature of the filament. This temperature is a function of the electric power dissipated in the filament. The anode current intensity is also dependent on the value of the high voltage applied between cathode and anode, but also on the power dissipated in the filament. For a given value of this high voltage, the quantity of X-rays emitted in the focus is proportional to the intensity of the anode current.

Most of the presently used diagnostic X-ray tubes comprise a rotating anode, which is rotated by means of mechanical bearings of the ball bearing type.

In such tubes, the only material contact between the rotating parts of the anode and the fixed parts of the pin connected to the positive polarity of the high voltage is brought about by the balls of these bearings. All the anode current passes through the contact points of these balls. It is known that mechanical bearing tubes have a shortened life, particularly due to the wear to the ball bearings. One of the causes of wear is the lubrication, which has to be a dry lubrication as a result of the vacuum in the tube.

An important improvement consists of installing the rotating anode with magnetic bearings. The latter generally comprise electromagnets arranged in pairs and in opposition, which produce magnetic fields under the influence of which a rotor, which is integral with the rotating anode whose rotation it ensures, is maintained in equilibrium. The rotating anode and the mechanical parts accompanying it in rotation are consequently not in mechanical contact with the remainder of the X-ray tube.

However, this causes a new problem, due to the fact that as the anode is mechanically insulated from the remainder of the tube, it is also electrically insulated therefrom. In addition, its high voltage connection and the flow of anode current make it possible to install means able to fulfil these functions in such tubes.

The solutions proposed are often friction piece or ball systems, i.e. mechanical and as a result part of the advantage of the magnetic bearing system is lost, namely the total absence of mechanical friction.

Another solution permitting the flow of anode current without mechanical contact uses the emission of electrons generated by thermo-emissive cathodes, mechanically connected to the rotating anode, said electrons being trapped by the fixed anode.

One of the main difficulties is then to supply the rotating thermo-emissive cathodes with the energy necessary for raising their temperature to an adequate level to comply with the thermoelectronic emission laws. Another difficulty encountered in this solution is the stabilization of the temperature of the thermo-emissive cathodes. As stated hereinbefore, the anode current of the tube is also dependent on the temperature of the electron source.

SUMMARY OF THE INVENTION

The present invention therefore relates to a rotating anode X-ray tube provided with a charge flow device, of the type using magnetic bearings, so that the anode current can flow without material contact between the fixed parts and the rotating parts of the tube, without it being necessary to use a thermo-emissive electron source, which is counter to the general tendency.

Thus, the present invention specifically relates to a rotating anode X-ray tube provided with a charge flow device, said charges constituting the anode current of the tube, the latter being of the type having magnetic bearings, said device being provided with an electron emitter electrically connected to the rotating anode and an electron collector electrically connected to the high voltage positive pole of the tube, wherein the emitter, coupled in rotation to the rotating anode, comprises at least one part having a tapered end, constituting an emissive electron zone, said electrons being trapped by the collector maintained in a fixed postion, so as to establish the anode current between the emitter and the collector without material contact between the latter and without requiring heating of the emitter.

In an X-ray tube according to the invention, the tapered ends with which the emitter is provided and formed by tips or tongues, have a sufficiently small radius of curvature of their ends to determine a multiplication factor at the electrical field existing on the surface of said ends, making it possible to establish an electric current between the emitter and the collector as a result of phenomena such as:

- the Schottky effect, in which the "potential barrier" prevailing on the surface of an electrode is lowered, thus making it possible to increase its electron emission, particularly when the radius of curvature of the surface of said electrode is very small;
- the cold emission, in which electrons can be emitted by an electrode by passing through the potential barrier by a "tunnel" effect;
- "low voltage" arc discharge, where electrons are emitted under a low voltage;
- the system formed by the emitter and the collector is also able to produce an electron emission forming a "cold plasma", which constitutes an electron source.

These possibly combined phenomena make it possible to produce a high electron current between the emitter and the collector, with a limited voltage drop which is not preJudicial to the satisfactory operation of the X-ray tube according to the invention.

BRIEF DESCRIPTION OF THE DRAWINGS

The invention is described in greater detail hereinafter relative to non-limitative embodiments and with reference to the attached drawings, wherein show.

DETAILED DESCRIPTION OF THE INVENTION

Figure 1:
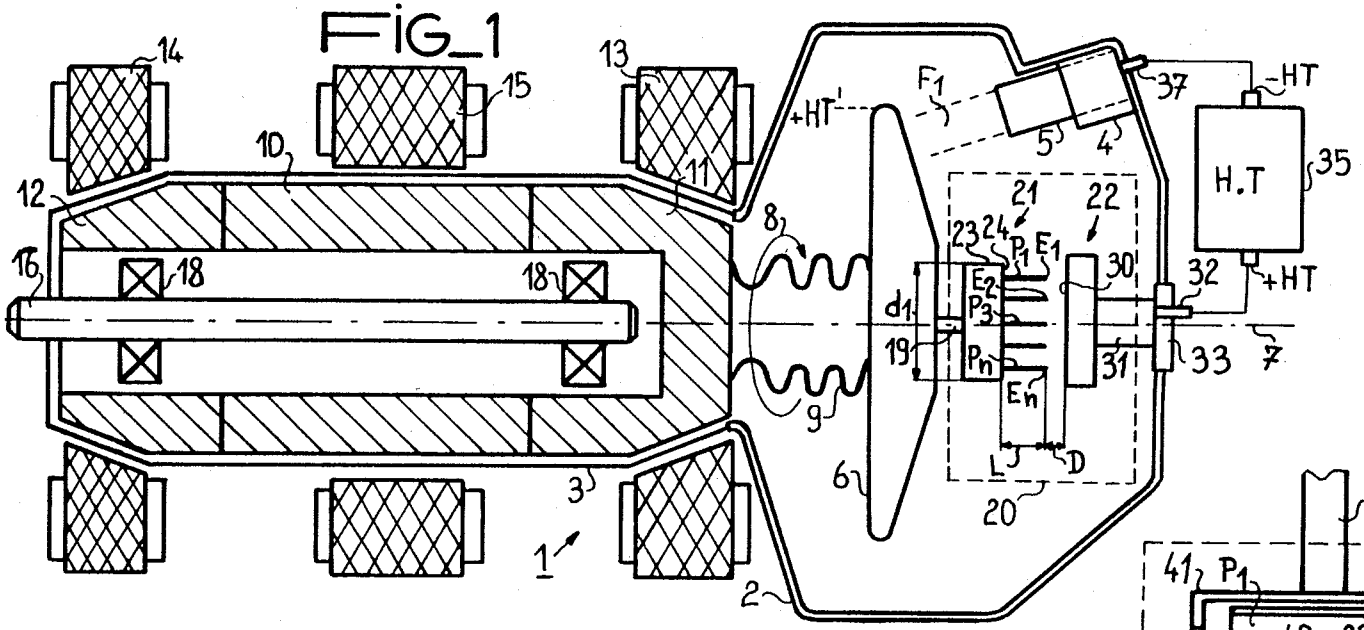
FIG. 1 diagrammatically, an X-ray tube according to the invention.

The X-ray tube 1 according to the invention shown in FIG. 1 comprises a vacuum tight envelope 2-3, which in the present case is constituted by an insulating part 2 and an end part 3 formed by a metal case or shell having a limited thickness. There is also a cathode 5 carried by a support 4 and by insulating part 2, supplies an electron beam Fl, whose impact on the rotating anode 6 causes the X-radiation.

The rotating anode 6 is centered on a longitudinal axis 7 of tube 1, about which it is rotated in the manner indicated by an arrow 8. Anode 6 is carried by a rotating shaft 9, e.g. made from a refractory and highly electrically insulating material, such as e.g. alumina or a ceramic material. Shaft 9 is integral with a rotating block constituted by a rotor 10 flanked at its ends by rotating parts 11, 12, the latter forming suspended parts of magnetic bearings 11-13 and 12-14. The active parts 13, 14 of the magnetic bearings are positioned outside shell 2-3. There is also a stator 15 which, with rotor 10, forms a motor used for rotating rotating anode 6. A fixed shaft 16 along the longitudinal axis 7 of tube 1 has guard bearings 18, which are not in contact with the rotating parts, except in the case of a failure of the magnetic suspension.

On the other side of insulating shaft 9, anode 6 is fixed to a metal spindle 19 arranged along the longitudinal axis 7 of the tube and it makes it possible to join anode 6 to a device 20 (shown in a dotted line square) used for the anode current flow.

In the non-limitative embodiment described, tube 1 according to the invention is shown with magnetic bearings 11-13, 12-14 positioned on the same side of anode 6. Another known arrangement, in which the magnetic bearings are rotated on either side of the anode also makes it possible to realise device 20 without passing beyond the scope of the invention. Device 20 has an emitter 21, which is coupled in rotation with the rotating anode 6, and a fixed collector 22.

In the present embodiment, emitter 21 is constituted by a metal base 23 electrically connected to the rotating anode 6 by metal spindle 19 and provided on an end face 24 with a plurality of metallic parts P1,P2,P3 . . . Pn, which are arranged parallel to longitudinal axis 7 have a tapered end E1,E2,E3 . . . En which is in the form of a point or tip in FIG. 1.

The tapered ends E1,E2,E3 . . . En can be electrically conductive, as in the case of the present embodiment where they are obtained from a material with a metal part P1,P2,P3 . . . Pn. However, these tapered ends E1,E2,E3 . . . En can also be non-conductive and can be made from a material having a low atomic number, such as boron or beryllium or a compound formed from these materials. Such a composition of the tapered ends E1, E2, E3 . . . En favors the production of a cold plasma, which constitutes an electron source, as has been stated hereinbefore.

In the same way as the rotating anode 6, parts P1, P2, P3 . . . Pn are rotated about the longitudinal axis 7. The rotation of tapered ends E1, E2, E3 . . . En takes place in a plane parallel to a collecting face 30 of collector 22 and facing said collecting face 30.

Collector 22, e.g. made from copper, is held in the present case by an electrically conductive support 31, by which it is connected to a first bushing 32, placed on a tight base 33 comprising envelope 2. The high voltage necessary for the operation of the tube is supplied in per se known manner by a high voltage generator 35 and a positive output +HT is connected to the first bushing 32 for application to collector 22. A negative output −HT is connected to a second bushing 37 for application in conventional manner to cathode 5, which also has other not shown connections necessary for its operation.

Thus, the conditions are provided for the evacuation of the negative charges, produced at rotating anode 6 by the bombardment of electron beam F1 generated by cathode 5.

The flow of these charges, which constitute the anode current, is obtained by a not shown emission of electrons by emitter 21 and more specifically by the tapered ends E1, E2, E3 . . . En constituted electron emission zones. These electrons are trapped by collector 22 without any material contact between the latter and emitter 21.

This arrangement of an X-ray tube 1 according to the invention is particularly advantageous, in that it makes it possible to ensure the flow of the anode current, without any material contact between the rotating parts and fixed parts of the tube by having at rotating anode 6 a high voltage value +HT', which differs only slightly from that of the positive output +HT applied to collector 22. This is obtained without requiring, as in the case of the prior art and as will be explained, heating means for supplying the energy for extracting the electrons from an auxiliary, not shown cathode, the electron quantity supplied by the auxiliary cathode being in this case mainly linked with the heating energy.

In the tube according to the invention, the electron generating capacity of emitter 21 is mainly linked with the geometrical characteristics of the device and particularly the curvature of the not shown surface of the tapered ends E1, E2, E3 . . . En, so that for a given high voltage value, the anode current is mainly limited by charges accumulated at the rotating anode 6 under the bombardment of electron beam 1. According to the inventive application of tube 1, distance D constituted by the space between a tapered end E1, E2, E3 . . . En and the collecting face 30 can vary, in the same way as the number of parts P1, P2, P3 . . . Pn, which can be limited to e.g. the central part P3.

In a non-limitative exemplified embodiment, device 20 has the following characteristics:

- end face 24 of base 23 has a circular surface with a diameter d1 of 20 mm;
- a length L of parts P1, P2, P3 . . . Pn is 10 mm, there being 50 such metal parts, which are uniformly distributed over end face 24;
- the distance D between a tapered end and the collecting face 30 is 0.1 mm;

the voltage established by the generator between its positive output +HT and its negative output −HT is 150 kV;

the anode current is 1 A;

the potential difference between the positive pole +HT and the high voltage at anode +HT' is 2 kV.

Figure 2:
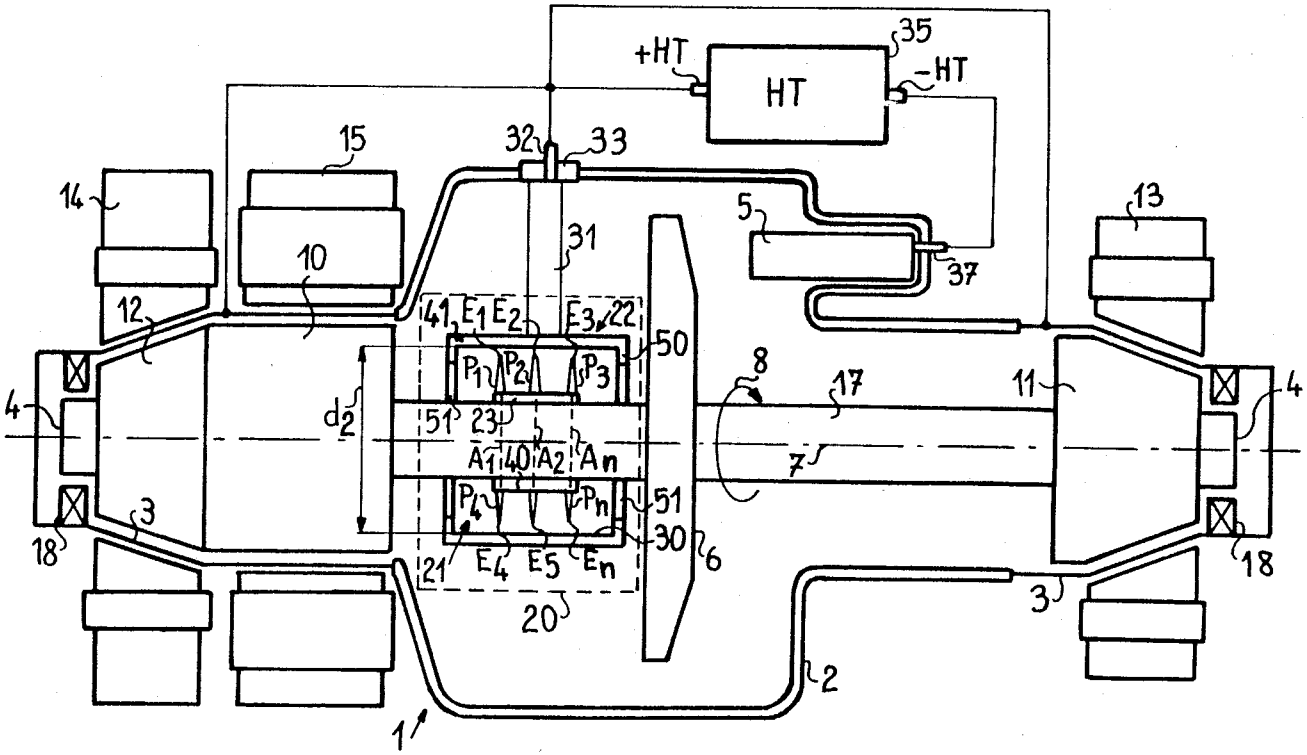
FIG. 2 the X-ray tube according to the invention in a first variant thereof.

The X-ray tube 1 according to the invention can have a material contact-free anode current flow device 20, arranged in the manner shown in FIG. 2. This version of device 20 is compatible both with a tube 1 according to the invention shown in FIG. 1 and with a tube 1 provided with magnetic bearings 11-13, 12-14 arranged on either side of rotating anode 6, as is also shown in FIG. 2.

Tube 1 according to the invention as shown in FIG. 2 comprises a vacuum tight envelope 2-3, constituted by the central insulating part 2 and by end parts 3 formed by metal shells of limited thickness. Cathode 5 carried by the central insulating part 2 serves to supply the not shown electron beam, whose impact on rotating anode 6 causes the X-radiation. Rotating anode 6 is carried by a metal spindle 17, integral with rotor 10, which forms with a stator 15 located at the end of envelope 2-3, the motor which ensures the rotation of rotating anode 6 about longitudinal axis 7, in accordance with arrow 8. Spindle 17 is also joined at its ends 4 to rotating parts 11, 12, which form the suspended parts of the magnetic bearings 11-13, 12-14. The active parts 13, 14 of magnetic bearings are positioned outside shell 2-3. Within the shell are provided guard bearings 18, which face the ends 4 of spindle 17, with which said bearings are only in contact in the case of a failure of the magnetic suspension. In this version, device 20 is positioned between rotating anode 6 and rotor 10.

Emitter 21 is supported by metal spindle 17, by which it is electrically connected to rotating anode 6 and like the latter it is rotated about longitudinal axis 7 in accordance with arrow 8. Emitter 21, centered on the longitudinal axis 7, rotates within the collector 22, which is hollow and is e.g. constituted by a cylinder. Collector 22 centered on longitudinal axis 7 is supported by a support 31, which leads to a first bushing 32. Openings 51 permitting the passage of spindle 17 are provided on walls 50 perpendicular to longitudinal axis 7.

As in the preceding embodiment, emitter 21 has a metal base 23, which is provided on its wall 40 parallel to longitudinal axis 7 with n parts P1, P2, P3 . . . Pn, whose pointed ends constitute the tapered ends E1, E2, E3 . . . En. In the non-limitative embodiment described, parts P1, P2, P3 . . . ..Pn are arranged along axes A1, A2. . . . An, which are parallel to one another and perpendicular to longitudinal axis 7, in such a way that in rotation ends E1, E2, E3 . . . En described not shown circles, which are smaller than the internal diameter d2 of collector 22 and which are centered on longitudinal axis 7. The tapered ends E1, E2, E3 . . . En rotate within collector 22 and, as in the previous embodiment, facing the collecting face 30. In the present embodiment, the latter is curved and is constituted by a cylindrical wall 41 of collector 22.

The positive output +HT of the high voltage generator 35 is connected to end walls 3, as well as to the first bushing 32 for application to collector 22 and the negative output -HT is connected to cathode 5, as hereinbefore. In this configuration, the active parts 13, 14 of magnetic bearings 11-13, 12-14 and stator 15 are raised to potential +HT in a conventional not shown manner, whilst the suspended parts 11-12 and rotor 10 are at potential +HT' of anode 6.

Figure 3:
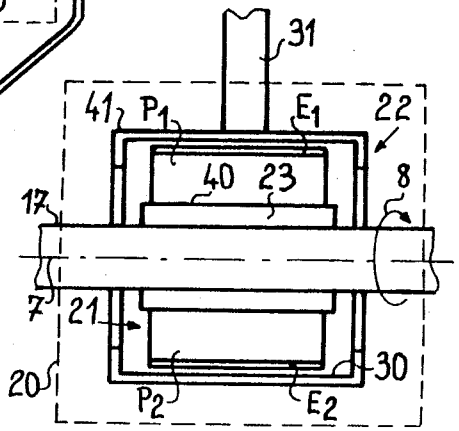
FIG. 3 a second variant of the characteristic means of the tube according to the invention.

Electron emission takes place in the same way as in the previous embodiment by tapered ends E1, E2, E3 . . . En, which permanently face collecting face 30 at a constant distance D of the latter and which is not shown in FIG. 2. FIG. 3 shows as a non-limitative embodiment, device 20 having a variant of the tapered ends E1, E2, E3 . . . En. As in the case of FIG. 2, collector 22 is hollow and contains emitter 21, but in this new configuration, the tapered ends E1, E2, E3 . . . En are constituted by the "razor edge" of N metal plates representing parts P1, P2, P3 . . . Pn and in the present case n is equal to 2 for reasons of clarity of FIG. 3. Parts P1, P2 are shaped like razor blades, whereof the razor flex forms the tapered ends E1, E2.

Parts P1, P2 are joined to base 23 in a conventional manner, e.g. by hard soldering and are arranged in such a way that the plane constituted by them includes longitudinal axis 7, about which they are rotated in accordance with arrow 8. Each tapered end E1, E2, formed by the razor flex of a part P1, P2 always face collecting face 30 during this rotation, as explained hereinbefore.

The use of tapered ends E1, E2 . . . En formed by the "razor edge" of part P1, P2, in the form of a tapered plate is also applicable to the embodiment of FIG. 1. In this case, said parts P1, P2 . . . Pn can be arranged on the end face 24 of face 23, along planes parallel to longitudinal axis 7.

Other arrangements can be realised, but fall within the scope of the invention if they involve arranging an electron emitter 21 electrically connected to anode 6, coupled in rotation with the latter and having parts P1, P2 . . . Pn at the tapered ends E1, E2 . . . En, as well as a fixed collector 22 connected to the positive pole +HT and having a collecting face 30 facing one or more of these tapered ends.

An X-ray tube according to the invention, in which the anode current flow and the fixing of the potential +HT' of anode 6 are ensured in a simple and reliable manner, is applicable to the production of high intensity X-radiation.

What is claimed is:

1. A rotating anode X-ray tube provided with a charge flow device mass for generating the anode current of the tube, the latter being of the type having magnetic bearings, said device means being provided with an electron emitter electrically connected to a rotating anode and an electron collector electrically connected to a high voltage positive pole of the tube, wherein the emitter, coupled in rotation to the rotating anode, comprises at least one part having a tapered end, constituting an electron emissive zone where electrons are emitted said electrons being trapped by the collector, said collector being maintained in a fixed position, said device means establishing the anode current between the emitter and the collector without material contact between the latter and without requiring heating of the emitter.

2. An X-ray tube according to claim 1, wherein the tapered end is constituted by a tip.

3. An X-ray tube according to claim 1, wherein the tapered end is constituted by an edge of a tapered plate or blade.

4. An X-ray tube according to any one of the preceding claims, wherein the tapered end is metallic.

5. An X-ray tube according to claim 1, wherein the tapered end is made from a material having a low atomic number.

6. An X-ray tube according to claim 5, wherein the tapered end is made from beryllium or boron, or one of the compounds thereof.

7. An X-ray tube according to claim 1, wherein the emitter is rotated about a longitudinal axis, the tapered end rotating facing a collecting face of the collector.

8. An X-ray tube according to claim 7, wherein the collecting face is flat.

9. An X-ray tube according to claim 1, wherein the collector is hollow, centered on the longitudinal axis and contains the emitter.

10. An X-ray tube according to claim 9, wherein the collector has a curved collecting face.

* * * * *